US005505385A

United States Patent [19]

Gengler

[11] Patent Number: 5,505,385

[45] Date of Patent: Apr. 9, 1996

[54] LAMINAR AIR DIFFUSER

[75] Inventor: Mark S. Gengler, Shelby, N.C.

[73] Assignee: Pneumafil Corporation, Charlotte, N.C.

[21] Appl. No.: 282,718

[22] Filed: Jul. 29, 1994

[51] Int. Cl.[6] ..... F26B 13/12

[52] U.S. Cl. ..... 239/553.3; 34/642

[58] Field of Search ..... 239/553, 553.3, 239/553.5, 590, 575; 34/629, 633, 640, 642

[56] References Cited

U.S. PATENT DOCUMENTS

| | | | |
|---|---|---|---|
| 1,977,947 | 10/1934 | Lufenbacher | 239/553.5 X |
| 3,127,080 | 3/1964 | Allender et al. | 34/642 X |
| 3,531,053 | 9/1970 | Miller et al. | 239/553.3 |
| 3,557,870 | 7/1971 | Kuroda | 34/642 X |
| 3,642,213 | 2/1972 | Laminar | 239/553 X |
| 4,397,103 | 8/1983 | Ruepp | 34/633 |
| 5,016,687 | 5/1991 | Kawamura | 239/553.5 X |
| 5,029,598 | 7/1991 | Srroszynski et al. | 239/553.3 X |
| 5,321,942 | 6/1994 | Hartness . | |
| 5,384,969 | 1/1995 | Troestsoher et al. | 34/629 X |

*Primary Examiner*—Kevin P. Weldon
*Attorney, Agent, or Firm*—Shefte, Pinckney & Sawer

[57] ABSTRACT

The present invention is an air diffuser for distributing conditioned air to air jet spinning machines and the like that includes a tubular outer member formed with openings therein and a tubular inner member disposed within the outer member. The inner tubular member is made of a fabric material that is formed in part with a relatively closed mesh construction and in part with a relatively open mesh construction so that the inner member emits air over a predetermined arcuate flow path through the open mesh part. The inner member directs the predetermined arcuate flow path into the outer member so that part of the conditioned air diffuses directly through the outer member in the predetermined arcuate flow path, the predetermined arcuate flow path preferably being directed towards the spinning machine. The conditioned air is thus delivered to the spinning machine at localized areas and at a low velocity.

7 Claims, 4 Drawing Sheets

LAMINAR AIR DIFFUSER

BACKGROUND OF THE INVENTION

This invention relates to an apparatus for distributing conditioned air and, more particularly, to a diffuser used in textile industries for distributing conditioned air to air jet or open end spinning machines in order to reduce the moisture deficit zone created by compressed air used in such spinning machines. It is also contemplated that the present invention may be employed in other textile applications, such as in air jet weaving machines.

It is well-known in modern textile yarn forming operations that the quality of yarn manufactured, whether natural, synthetic, or a mixture thereof, is dependent to some extent upon the condition of the ambient air in which the yarn is produced. For example, the humidity and temperature of the ambient air are kept within predetermined limits to reduce yarn breakage in spinning and weaving operations.

Fairly recently, textile yarn manufacturers began using air jet spinning machines, which employ compressed air in carrying out the yarn spinning process. Typical air jet spinning machines of this type are manufactured by Murata Corporation, among other manufacturers, and can include up to sixty or more spinning positions per spinning machine. This compressed air is relatively dry compared to the optimum humidity and temperature levels for manufacturing yarn, and the adverse effects of such compressed dry air have been countered by supplying conditioned air to the spinning room as a whole. However, this is an inefficient method of conditioning the yarn because the conditioned air must occupy a large volume of space and be directed over large distances to reach the sliver and yarn being processed by air jet spinning machines. Directing strong currents of conditioned air toward the machine may also create problems because conditioned air with other than small velocities can interrupt the spinning process and can cause the sliver to fuzz, which reduces the quality of the yarn. Furthermore, generally directing conditioned air at air jet spinning machines is often ineffective in sufficiently reducing the demoisturizing effects of the compressed air. In fact, it is frequently not feasible to spin pure cotton yarn in air jet spinning machines due to numerous breakdowns from sliver breakage, and one of the reasons for this breakage appears to be the dry condition of the compressed air in the spinning process.

SUMMARY OF THE INVENTION

In accordance with the present invention, an air diffuser is provided for use in distributing conditioned air to textile equipment such as open end or air jet spinning machines, such air diffuser comprising a tubular outer member made of a generally rigid material, such as metal, and having a plurality of openings in such material along at least a major portion thereof. The air diffuser also includes a tubular inner member made of a fabric material and having one open end for receiving conditioned air, the inner member being disposed within the outer member substantially co-axially therewith. The fabric material of the inner member is formed with a first longitudinally-extending portion having a relatively closed mesh construction and a second longitudinally-extending portion having a relatively open mesh construction, and the second open mesh construction is positioned within the outer member to emit or discharge the conditioned air within the outer member over a predetermined arcuate flow pattern which is diffused through the openings in the outer member.

In one embodiment of the present invention, the inner member is generally cylindrical in shape, and the aforesaid first portion thereof consists of at least one arcuate half of the cylindrical shape, with the aforesaid second portion of the inner member being formed in the other arcuate half of the cylindrical shape. The inner member may also be tapered from a larger diameter at its open end to a smaller diameter at its other end to thereby assist in equalizing the flow of the conditioned air along the extending length of the air diffuser.

In another embodiment of the present invention, the inner member is generally cylindrical in shape, and the aforesaid second portion thereof is formed by two longitudinally-extending strips of open mesh, with the two strips being arcuately spaced from one another.

In both embodiments, the open end of the inner member is fixed to a mounting plate, and the mounting plate may be rotated to vary the position of the second portion of the inner member without the outer member so as to vary the direction of the diffused air flow being discharged from the air diffuser.

BRIEF DESCRIPTION OF THE DRAWINGS

FIG. 1 is a diagrammatic view showing generally the location of the air diffuser of the present invention in conjunction with an air jet spinning machine or the like;

DESCRIPTION OF THE PREFERRED EMBODIMENTS

Figure 1:
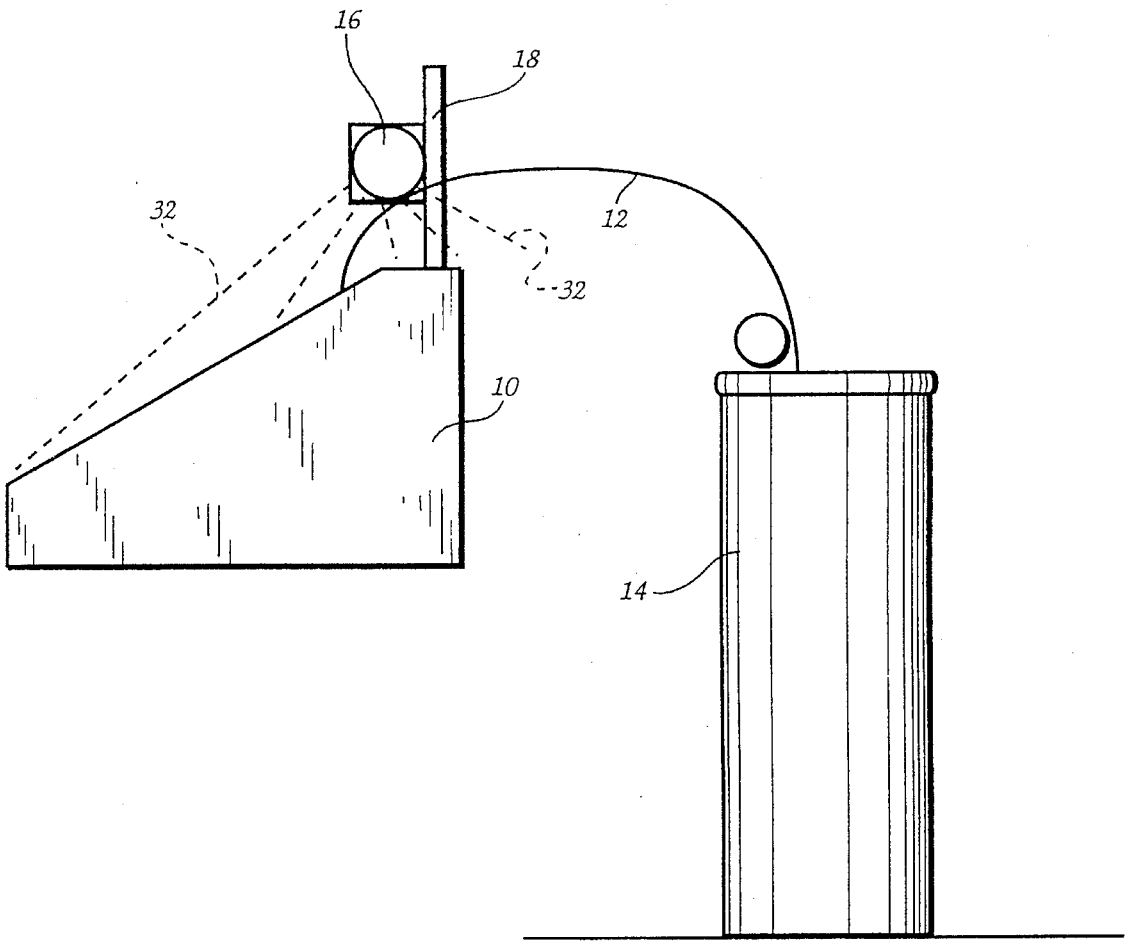

Looking now in greater detail at the accompanying drawings, FIG. 1 illustrates diagrammatically, and very generally, and air jet spinning machine 10 receiving sliver 12 from a sliver can 14, in a conventional manner. An air diffuser 16 of the present invention is mounted directly above the air jet spinning machine on any suitable support structure 18. As discussed above, typical spinning machines 10 may have sixty or more spinning positions spaced along the length thereof, and the air diffuser 16 is arranged above the spinning machine 10 so that its axis is disposed along the extending length of the spinning machine 10.

Figure 2:
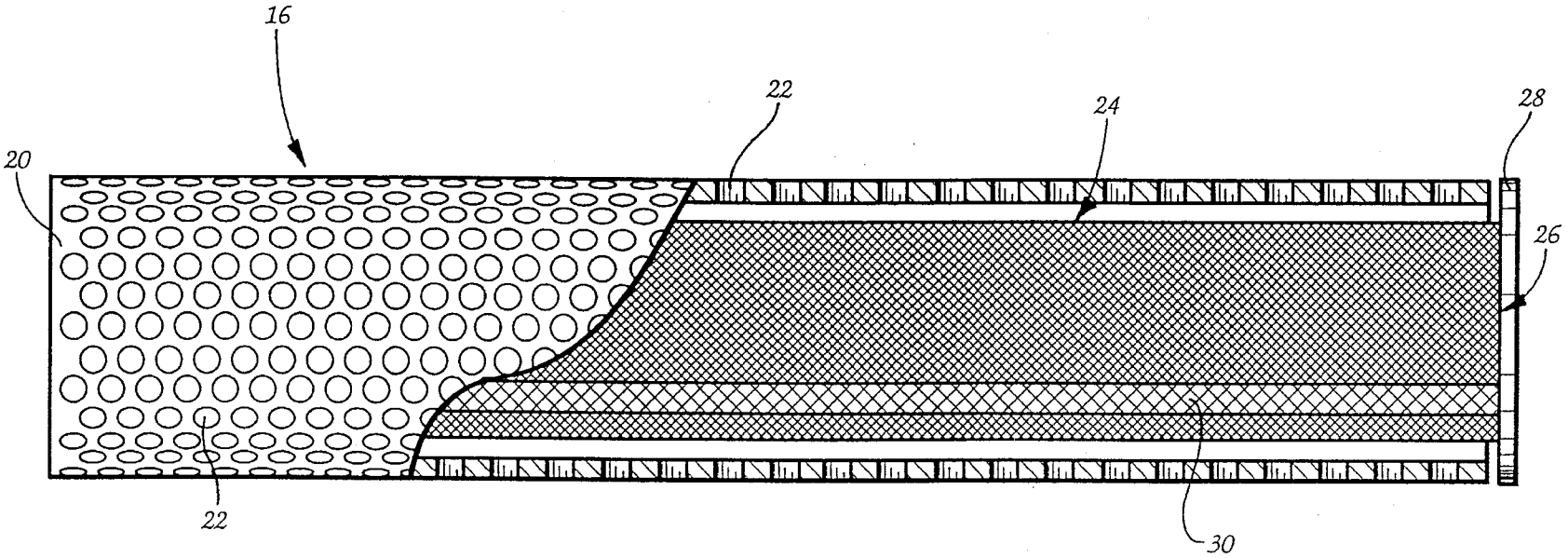
FIG. 2 is a detailed view, partially in section, illustrating one embodiment of the air diffuser of the present invention.
Figure 3:
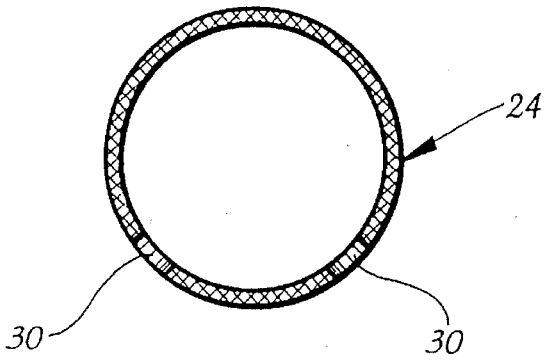
FIG. 3 is a vertical section view of the inner member of the air diffuser illustrated in FIG. 2.
Figure 4:
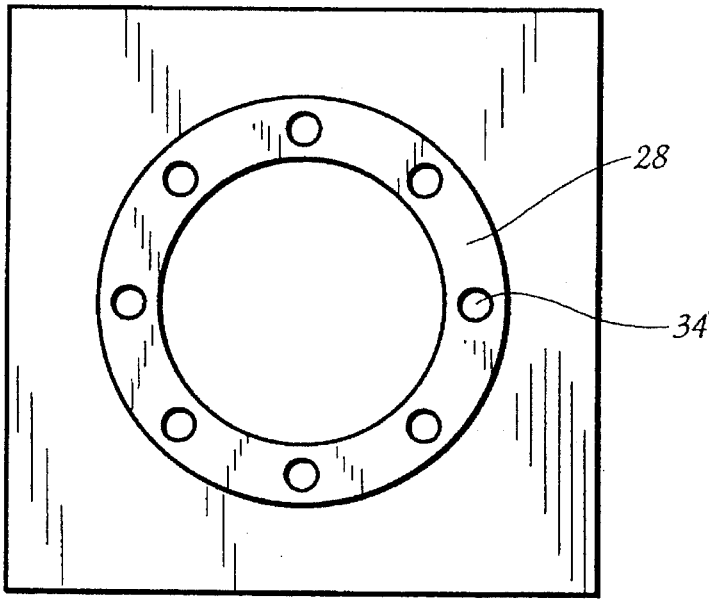
FIG. 4 illustrates the mounting plate of the air diffuser of the present invention.

FIGS. 2–4 illustrate one embodiment of the air diffuser 16 of the present invention, which is comprised of an outer member 20 that is preferably cylindrical in shape and formed of a rigid material such as metal, and the outer member 20 has a large plurality of openings 22 formed therein, the openings 22 being formed in the outer member 20 along at least a major portion thereof and preferably along the entire extending length of the outer member 20.

As best seen in FIG. 2, a tubular inner member 24, made of a fabric material, such as a canvas-like material, is disposed within the outer member 20 substantially co-axially therewith, and with the outer surface of the inner member 24 being spaced from the interior surface of the outer member 20. The tubular inner member 24 is open at one of its ends 26, which is fixed to a mounting plate 28, and conditioned air for any convenient source (not shown) is blown into the interior of the inner member 24 through its open end 26.

Except for two longitudinally-extending strips 30, the entire tubular inner member 24 is formed of a fabric having a relatively closed mesh which permits only a small amount of the conditioned air to pass through the interstices of the relatively closed mesh fabric. On the other hand, the fabric material of the inner member 24 is woven or otherwise formed to include the two longitudinally extending strips 30 with a relatively open mesh construction through which the conditioned air can pass more freely and, as best seen in FIG. 3, the two open mesh strips 30 are arcuately spaced from one another at the lower portion of the inner member 24.

By virtue of this construction, when the air diffuser 16 of the present invention is mounted above a spinning machine 10 as described above, conditioned air which is introduced into the air diffuser 16 through its open end 26 will cause the fabric inner member 24 to balloon out into a position extending axially along, and spaced from, the interior surface of the outer member 20. Moreover, because the arcuately spaced strips 30 have a relatively open mesh construction as compared with the remainder of the fabric material forming the inner member 24, the conditioned air will flow relatively freely outwardly from the inner member through the strips 30 to define a generally arcuate air flow. This air flow almost immediately encounters the interior surface of the outer member 20, which interrupts the air flow and diffuses it further by making it flow through the plurality of openings 22 in the outer member 20. As a result, the conditioned air is emitted from the air diffuser 16 along a somewhat arcuate flow path that is directed toward the spinning machine 10 as indicated generally by the air flow lines 32 in FIG. 1.

Thus, substantially the entire volume of conditioned air is directed specifically to the area where it is most needed, namely, directly at the operating portion of the spinning machine where the relatively dry compressed air tends to create adverse humidity and temperature problems, as discussed above. Additionally, it is particularly significant to note that this conditioned air is not only being directed to the area where it is most needed, the unique combination of the inner member 24 and outer member 20 also results in the conditioned air being continuously diffused in a manner that substantially eliminates direct or high velocity currents of conditioned air that can foul or even break the somewhat fragile yarn being formed by the spinning machine 10.

Accordingly, the air diffuser 16 of the present invention provides a flow of conditioned air that simultaneously directs the air toward the spinning machine and diffuses the air so that it will not adversely affect the operation of the spinning machine 10. Finally, since the conditioned air in most spinning mills is simply ambient air within the spinning room that is recirculated through air conditioning equipment, such air may, and usually does, include some lint and similar foreign material that may not have been filtered from the air during recirculation, and such lint and foreign material may be filtered from the conditioned air as it passes through the interstices of the fabric material forming the inner member 24.

It will be apparent that the arcuate spacing of the strips 30, and the size, number, and mesh of the strips may also be varied, all for the purpose of customizing the desired flow pattern of the conditioned air for any particular spinning machine or other textile operation. Additionally, the mounting plate 28 is preferably formed with a large number of holes 34 by which it is mounted to the support structure 18 using conventional nuts and bolts (not shown), and this large number of holes 34 permits further rotational adjustment of the air diffuser 16. For example, as shown in FIG. 4, the mounting plate 28 may have eight holes 34, in which case it can be disconnected from the support structure 18, rotated in arcuate segments of 45° (360°÷8 holes) and remounted on the support structure 18 to thereby vary the direction of flow path of the conditioned air as it leaves the air diffuser 16.

Figure 5:
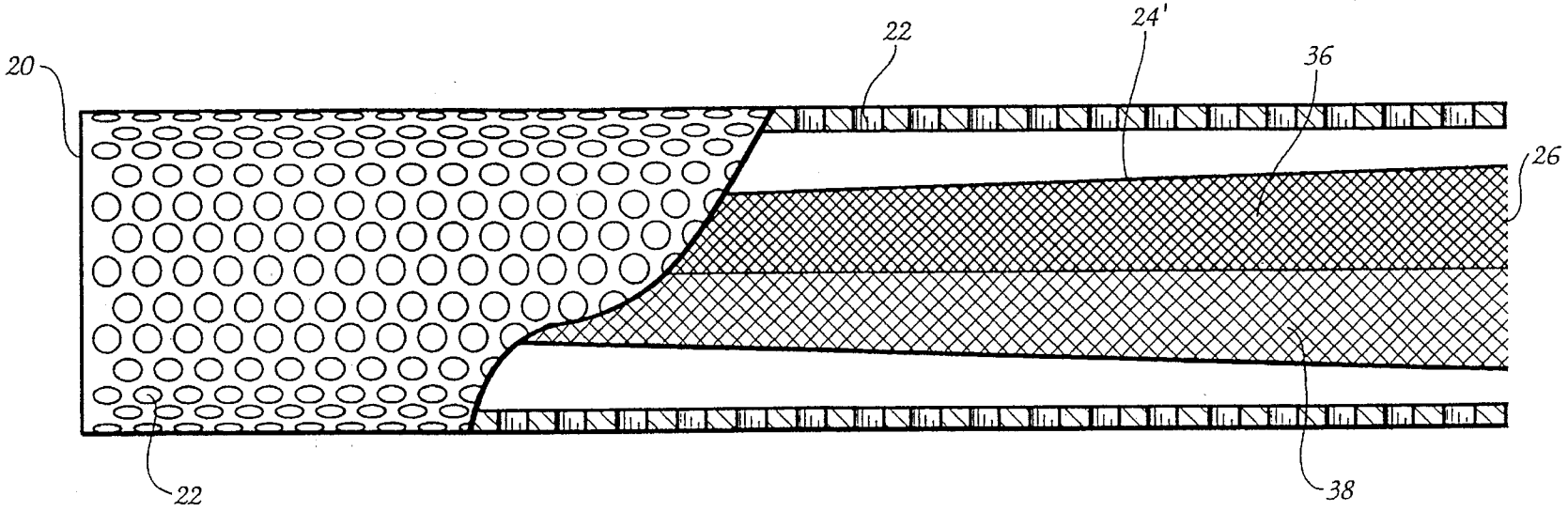
FIG. 5 is a detailed view, partially in section, illustrating a second embodiment of the air diffuser of the present invention.

FIG. 5 illustrates a second embodiment of the present invention, which is identical to the embodiment described above in connection with FIGS. 2–4, except for the construction of the fabric inner member 24'. In this embodiment, rather than having open mesh strips that extend along the length of the inner member, the fabric material of the inner member 24' which is preferably a canvas-type material, is formed with its entire upper arcuate half 36 having a relatively closed mesh construction, and its entire lower arcuate half 38 having a relatively open-mesh construction. Additionally, it is preferred that the inner member 24' be formed with a gradually decreasing taper extending from its open end 26 towards its closed end so that the pressure of the conditioned air along the entire length of the inner member 24' is substantially equal notwithstanding the friction losses of the conditioned air passing along the interior surface of the inner member 24' whereby substantially equal amounts of air are emitted through the lower arcuate half 38 along the entire extending length thereof. This air is then diffused as it passes through the openings 22 in the outer member 20 in the same manner as that described above. Again, it will be appreciated that the arcuate extent of the lower arcuate half 36, and the relative size of the open mesh construction, may be varied to customize the flow pattern of the conditioned air for any particular application, and the entire air diffuser 16 may be rotated through arcuate segments using the mounting plate 28 in the same manner as that described above. Thus, the embodiment of the present invention which is illustrated in FIG. 5 offers all of the advantages described above in connection with the first embodiment.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An air diffuser for use in distributing conditioned air to textile equipment, such as air jet spinning machines, comprising:

(a) a tubular outer member made of a generally rigid material and having a plurality of openings formed in said material along at least a major portion thereof; and (b) a tubular inner member made of a fabric material and having one open end for receiving said conditioned air, said inner member being disposed within said outer member substantially co-axially therewith and said fabric material being formed with a longitudinally-extending first portion having a relatively closed mesh construction and a second longitudinally-extending portion having a relatively open mesh construction, and said second portion being positioned within said outer member to emit said conditioned air within said outer member over a predetermined arcuate flow pattern which is diffused through said openings in said outer member.

2. An air diffuser as defined in claim 1 wherein said inner member is generally cylindrical in shape, and wherein said first portion thereof comprises at least one arcuate half of said cylindrical shape.

3. An air diffuser as defined in claim 2 wherein said inner member is tapered from a larger diameter at said open end thereof to a smaller diameter at its other end to equalize the flow of said conditioned air along the extending length of said air diffuser.

4. An air diffuser as defined in claim 1 wherein said inner member is generally cylindrical in shape, and wherein said second portion of said inner member is formed by two longitudinally-extending strips of open mesh, said two strips being arcuately spaced from one another.

5. An air diffuser as defined in claim 1 wherein said open end of said inner member is fixed to a mounting plate, and wherein said mounting plate may be rotated to vary the rotational position of said second portion of said inner member.

6. An air diffuser as defined in claim 5 wherein said outer member has said openings therein formed along substantially the entire extending length thereof.

7. An air diffuser for use in distributing conditioned air to textile equipment, such as an air jet spinning machine, comprising:

(a) a tubular outer member made of a generally rigid material and having a plurality of openings formed in said material along at least a major portion thereof; and (b) a tubular inner member made of a fabric material and having one open end for receiving said conditioned air, said inner member being disposed within said outer member substantially co-axially therewith and said fabric material being formed with a longitudinally-extending first portion having a relatively closed mesh construction and a second longitudinally-extending portion having a relatively open mesh construction, and said second portion being positioned within said outer member to emit said conditioned air from said inner member into said outer member over a predetermined arcuate flow pattern for diffusing through said openings in said outer member in another predetermined arcuate flow pattern.

* * * * *